US008449217B2

(12) United States Patent
DiPizio et al.

(10) Patent No.: US 8,449,217 B2
(45) Date of Patent: May 28, 2013

(54) TRENCH PAVER ATTACHMENT

(76) Inventors: Martin DiPizio, Cheektowaga, NY (US); Gregory Skora, North Collins, NY (US)

( * ) Notice: Subject to any disclaimer, the term of this patent is extended or adjusted under 35 U.S.C. 154(b) by 0 days.

(21) Appl. No.: 13/286,142

(22) Filed: Oct. 31, 2011

(65) Prior Publication Data

US 2013/0108365 A1 May 2, 2013

(51) Int. Cl.
*F16L 3/00* (2006.01)
*E02F 5/12* (2006.01)

(52) U.S. Cl.
CPC ..... *E02F 5/12* (2013.01)
USPC ..... 404/83; 405/179

(58) Field of Classification Search
CPC ..... E02F 5/12
USPC ..... 404/83, 92; 405/179
See application file for complete search history.

(56) References Cited

U.S. PATENT DOCUMENTS

| | | | | |
|---|---|---|---|---|
| 3,181,258 | A | 5/1965 | Duncan | |
| 3,195,249 | A | 7/1965 | Collins | |
| 3,215,292 | A | 11/1965 | Halls | |
| 3,471,953 | A | 10/1969 | Wyatt | |
| 3,794,195 | A | 2/1974 | Clevenger | |
| 3,797,582 | A | 3/1974 | Couch | |
| 3,934,363 | A | 1/1976 | McMurray | |
| 4,283,867 | A | 8/1981 | Brown | |
| 4,507,012 | A | 3/1985 | Corcoran | |
| 4,539,765 | A | 9/1985 | Reece | |
| 4,802,293 | A | 2/1989 | Smith | |
| 4,842,441 | A | 6/1989 | Watkins | |
| 5,098,252 | A | 3/1992 | Sheesley | |
| 5,353,529 | A | 10/1994 | McCullough | |
| 5,479,728 | A | 1/1996 | Deken | |
| 5,511,932 | A | 4/1996 | Todd | |
| 6,152,648 | A * | 11/2000 | Gfroerer et al. | 404/84.05 |
| 6,434,861 | B1 | 8/2002 | McCullough | |
| 6,698,527 | B1 * | 3/2004 | White et al. | 172/450 |
| 7,104,726 | B2 | 9/2006 | Wallace | |
| 7,255,512 | B2 | 8/2007 | Wallace | |
| 7,540,103 | B2 * | 6/2009 | Broten | 37/276 |
| 7,824,127 | B1 * | 11/2010 | Shunn et al. | 404/75 |
| 2011/0085860 | A1 | 4/2011 | Gregerson | |

* cited by examiner

*Primary Examiner* — Raymond W Addie
(74) *Attorney, Agent, or Firm* — John C. Thompson

(57) ABSTRACT

A trench paver attachment which can be used to backfill a trench to varying grade heights, the attachment being designed primarily for use on paved roads. The attachment in one configuration is able to backfill a trench with crushed rock and cement or the like to a suitable height corresponding to the base of the adjacent pavement, and in another configuration it is able to apply base, binder and top in whatever lifts are called for. The attachment may be adjusted to allow for the paving of any trench from an 18" width up to a 96" width, which widths may be varied by the operator during the course of paving the trench.

5 Claims, 7 Drawing Sheets

TRENCH PAVER ATTACHMENT

TECHNICAL FIELD

The present invention relates generally to a trench paver attachment and more particularly to one which can be used to backfill a trench to varying grade heights.

BACKGROUND OF THE INVENTION

Machines for backfilling trenches are well known in the art. Some machines may use augers, typical examples being shown in U.S. Pat. Nos. 3,934,363, 4,283,867, 5,353,529, 5,479,728, and 6,434,861. Some of these devices may be provided with additional structure for tamping or compacting the backfill material after it has been placed in the trench.

In addition to the auger class of machines, another type of machine uses a pair of blades to push the backfill material back into the trench. Typical machines are shown in U.S. Pat. Nos. 3,195,249, 3,471,953, 3,797,582, 4,802,293, and 7,104,726. Other machinery is shown in U.S. Pat. Nos. 3,181,258, 4,507,012, 4,539,765, and 4,842,441.

Most of the patented designs referred to above are not designed for use with paved roads. Thus paved roads usually require a backfill to a prescribed height, and then typically a first fill of base, a second fill of a binder, and a top fill of asphalt, which fills may be of varying heights and widths, the fills in the trade typically being called lifts.

When laying pipe, such as a waterline, in a street paved with asphalt it is conventional to cut the pavement to the desired width necessary for excavation of pipeline trench. The cut pavement is then removed to provide a clean uniform edge with minimum disturbance of the remaining pavement. After the pipe is layed, material removed from the trench may be used for backfill if suitable and if permitted by local codes, otherwise crushed rock and cement or the like is used for backfill. The trench is backfilled so that the top surface of the compacted upper lift of backfill after compacting matches the bottom of the adjacent pavement. Asphalt is then placed on the backfill. Typically three lifts of asphalt are placed over the compacted backfill, the first lift being a base of course aggregate, the next lift being a binder course, and the final lift being a top course. Each of the various lifts is typically dumped onto the backfill or the previous lift of asphalt, and is then hand shoveled to that it fully covers the previous lift with a slight crown so that after rolling it is of the desired height. For example, the first lift of course aggregate asphalt is placed in such a manner that after rolling its top surface will be 3 inches below the surface of the adjacent pavement. The next lift, the binder lift of asphalt, will be hand worked so that after rolling it will be about 1½ inches below the surface of the pavement. The top wearing course is then placed so that its initial height is about 1 inch above the top surface of the adjacent pavement so that, after rolling, its height is at the same height as the adjacent pavement.

OBJECTS AND SUMMARY OF THE INVENTION

It is an object of the present invention to provide an apparatus which may be used on roads paved with asphalt which, in one configuration, is suitable for backfilling a trench with crushed rock and cement or the like to a suitable height corresponding to the base of the adjacent pavement, and then, in other configurations, to place varying lifts of paving material to suitable heights so that after rolling the final lift of paving material is of a height which corresponds to adjacent paved surface.

More particularly it is an object of the present invention to provide a trench paver attachment for a skid steer loader or the like, which attachment is able to grade, subgrade, and apply base, binder and top in whatever lifts are called for, and which attachment may be adjusted to allow for the paving of any trench from an 18" width up to a 96" width, which widths may be varied by the operator during the course of paving the trench.

The above objects and other objects and advantages of this invention will become more apparent after a consideration of the following detailed description taken in conjunction with the accompanying drawings in which a preferred form of this invention is illustrated.

DETAILED DESCRIPTION

Right and left hand reference is determined by standing behind the skid steer loader and facing its direction of travel. In addition, forward and rear references are determined by the normal forward direction of the loader, i.e., to the left in FIG. 1.

Figure 1:
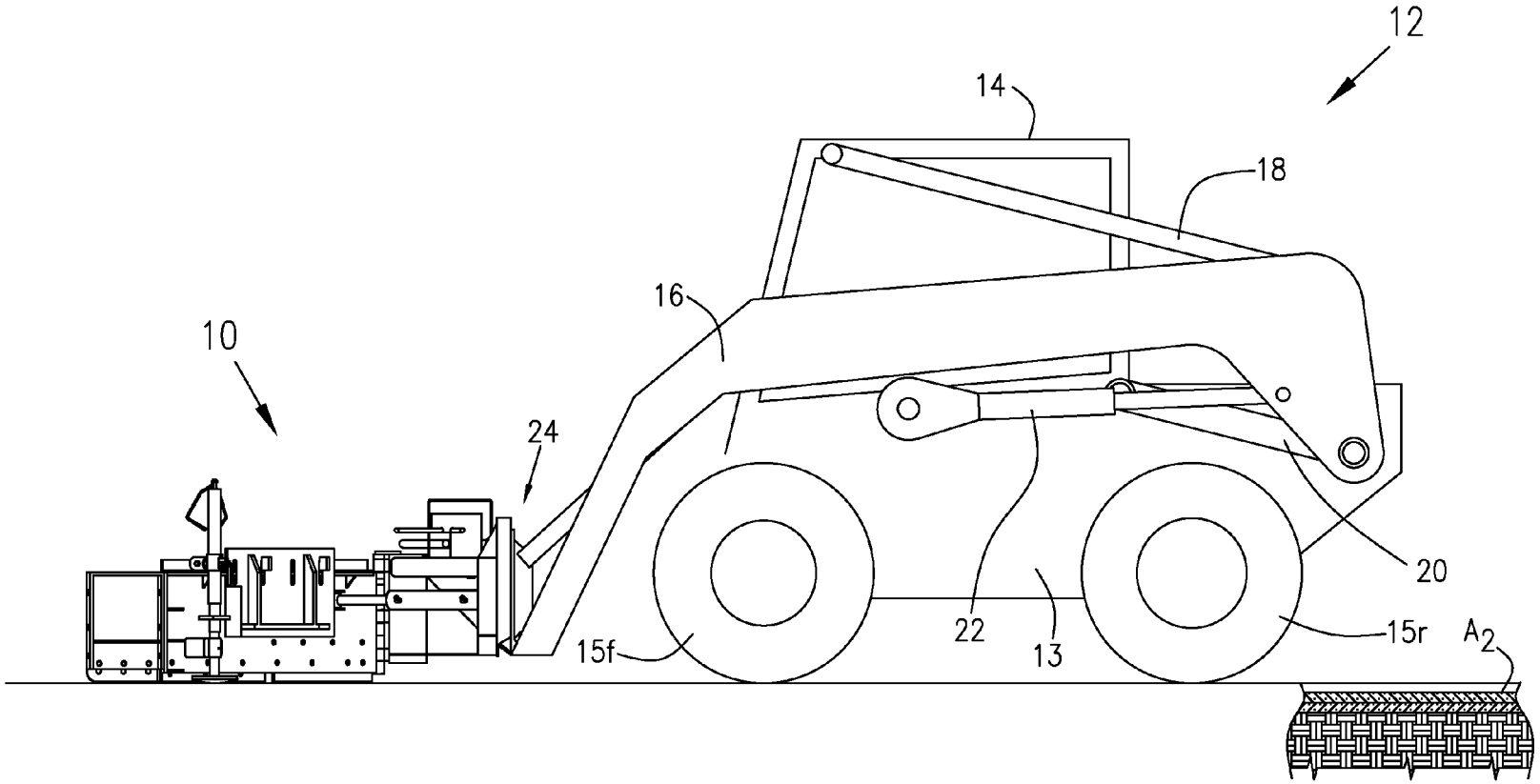
FIG. 1 is a somewhat schematic side view of a skid steer loader carrying the trench paver attachment of this invention, and showing the first and second lifts of asphalt on a compacted base in a trench behind the skid steer loader.
Figure 2:
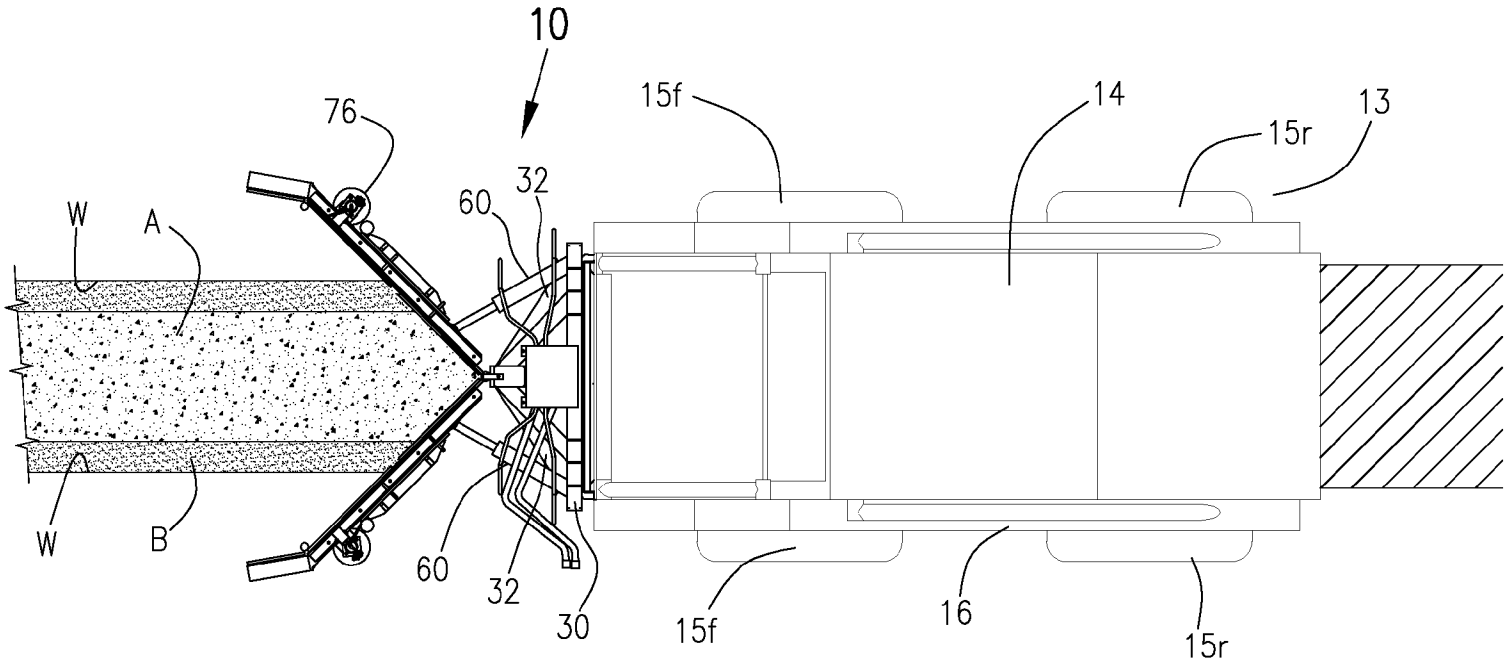
FIG. 2 is a top view of the attachment shown in FIG. 1 and showing a pile of asphalt in a trench, the asphalt overlying the compacted back fill material.

With reference first to FIGS. 1 and 2, the trench paver attachment of this invention is indicated generally at 10. As shown in these figures, the trench paver attachment is mounted on a skid-steer loader indicated generally at 12, the loader being of the type shown generally in U.S. Pat. No. 3,215,292 and U.S. Pat. No. 5,511,932. The loader includes a chassis 13 and cab 14, the loader being supported on front and rear wheels 15*f* and 15*r*. As is conventional, the skid steer loader is provided with right and left booms 16. In the illustrated design the booms are supported by upper and lower parallel links 18, 20, respectively. The booms can be raised and lowered by means of right and left simultaneously operated hydraulic lift cylinders 22. In addition, the booms carry at their forward ends a mounting plate assembly indicated generally at 24. A typical mounting plate assembly is shown in U.S. Pat. No. 3,794,195; however other designs of mounting plates may be used.

Figure 3:
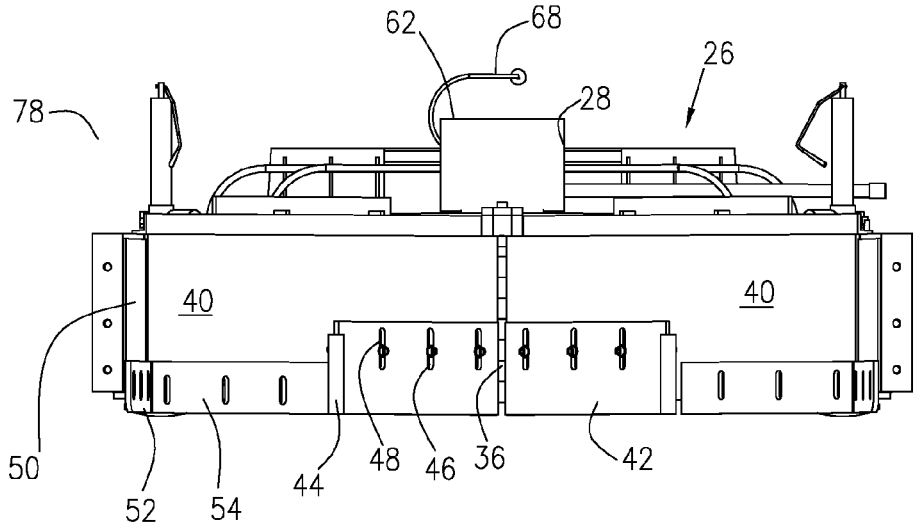
FIGS. 3 and 4 are front and rear views, respectively, of the attachment shown in FIGS. 1 and 2.
Figure 4:
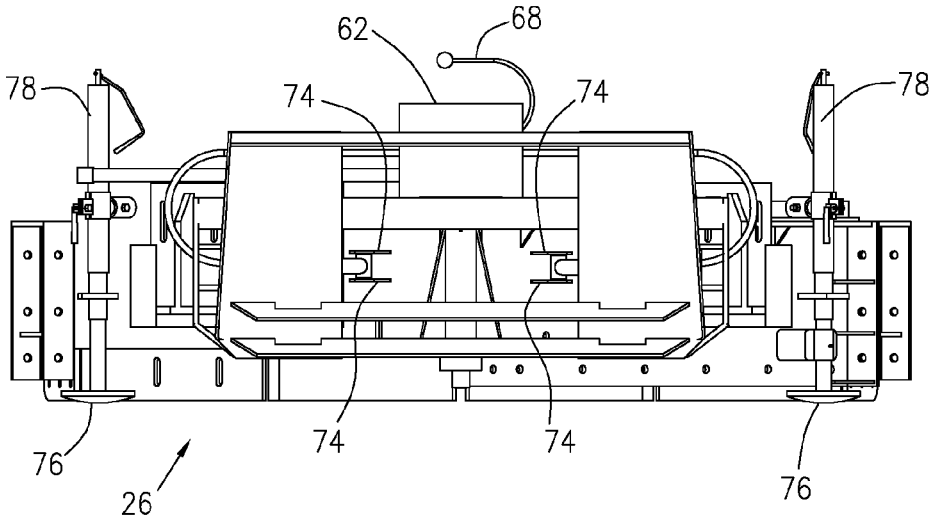
Figure 5:
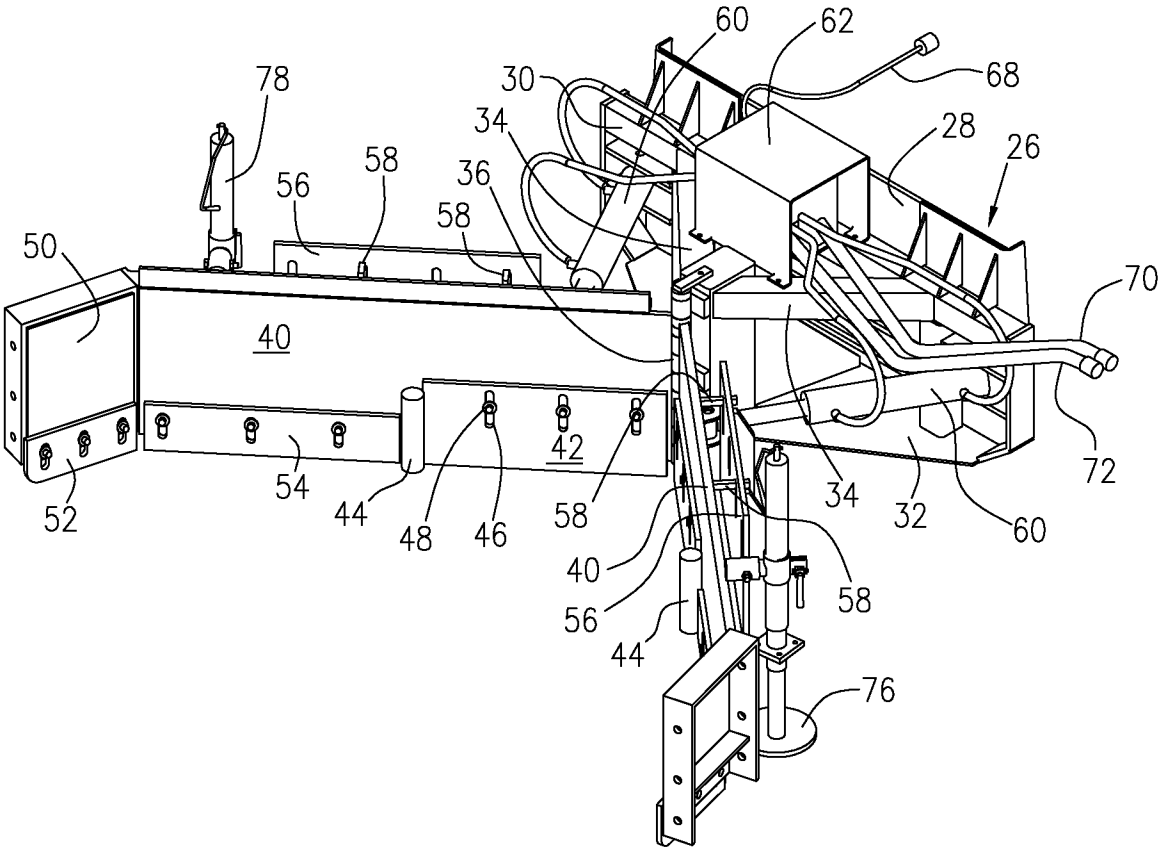
FIG. 5 is a perspective view of the attachment shown in an intermediate position.

With reference now to FIGS. 3-5, the trench paver attachment of this invention includes a rear support assembly 26 which is adapted to be secured to the mounting plate assembly 24. As differing designs of rear support assemblies may be employed, depending upon the particular mounting plate assembly to which it is to be secured, it will not be described in detail. However, it includes in the illustrated embodiment a plate 28 which has welded thereto a transversely extending upper box beam 30 and a lower triangular plate 32. A pair of upper box beams 34 extend forwardly from the upper box beam in a V-shaped configuration. Carried at the forward ends of the upper forwardly extending box beams 34 and the lower triangular plate 32 is a vertically extending pivot pin assembly 36. Carried by the pivot pin assembly are right and left blade assemblies, which assemblies are mirror images of each other.

Figure 6:
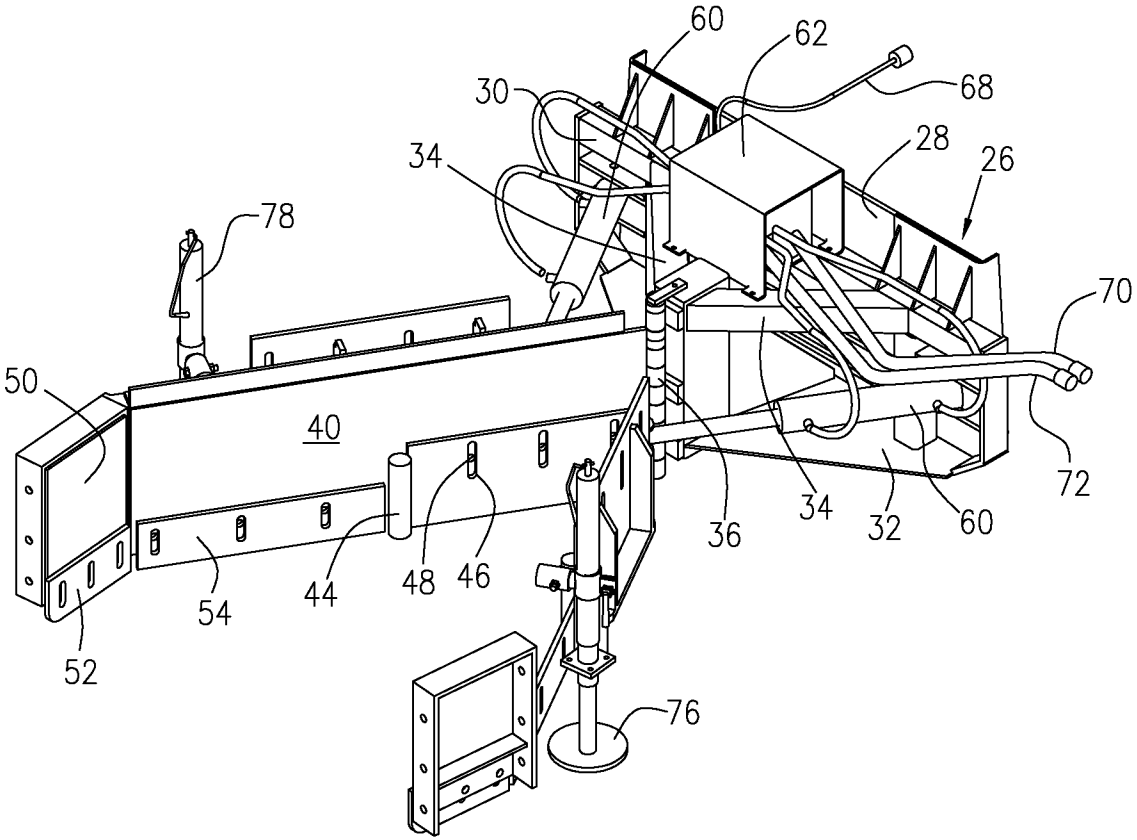
FIGS. 6 and 7 are perspective views showing the attachment is its narrowest position in FIG. 6 for filling a trench of 18 inches width and its widest position in FIG. 7 for filling a trench of a 96 inch width.
Figure 7:
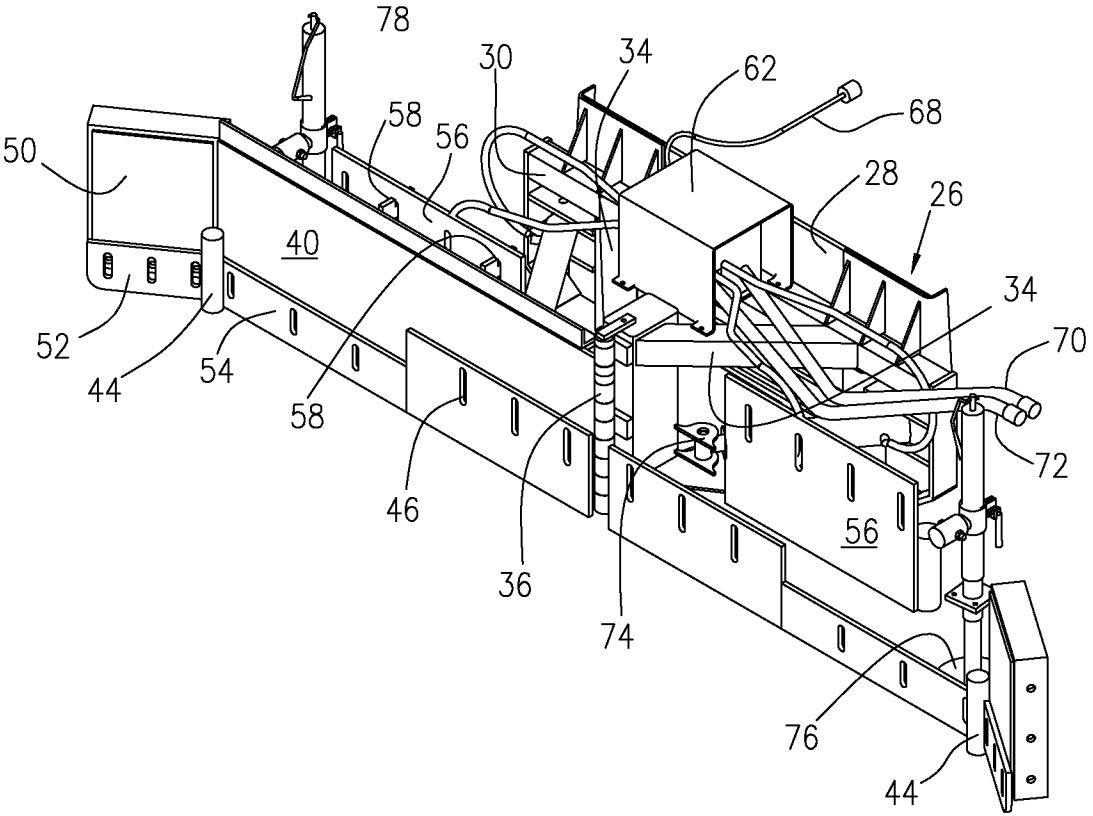
Figure 8:
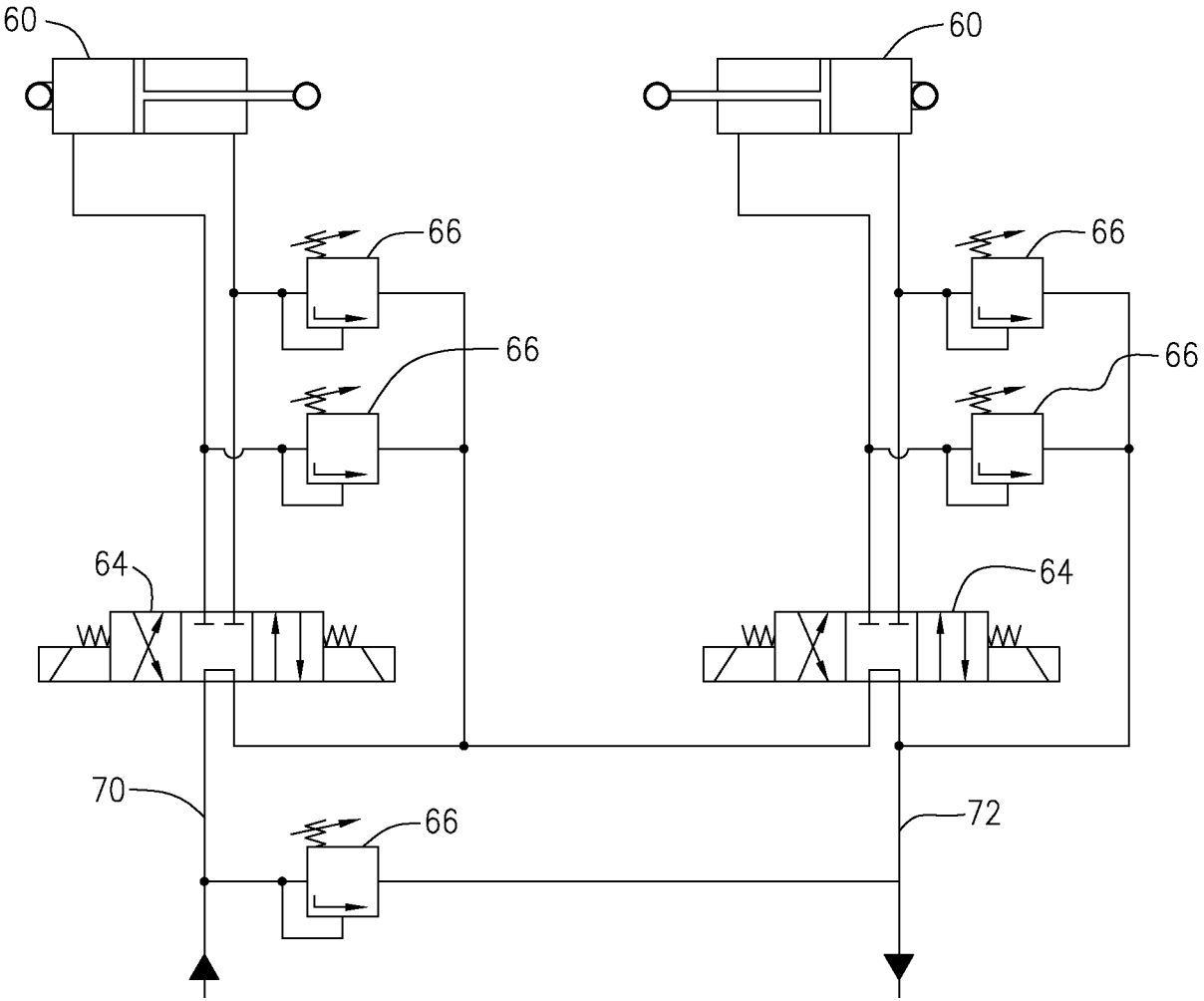
FIG. 8 is a schematic illustration of the fluid circuit used for varying the width of the trench paver attachment of this invention.

Each of the blade assemblies includes a primary blade 40, only the right primary blade being illustrated in FIGS. 6 and 7, the left primary blade not being illustrated in these FIGS. so that other parts can be viewed. Mounted on each blade is one or more adjustable scraper blades 42 which level the asphalt placed in the trench during forward movement of the attachment. As shown in FIG. 5, when the attachment is set for a 24 inch trench, an innermost scraper blade is provided with a round bar 44 which slides along the side of the cut pavement. In the event that there is something which would interfere with the sliding movement, the round bar will cause the blade to move to the center of the trench an inch or so, thus preventing the equipment from incurring damage. As can be seen each of the scrapers 42 is adjustably mounted on the primary blade 40. Thus, each scraper 42 is provided with slots 46 which receive bolts 48 or the like, the bolts being loosened to permit vertical adjustment of the associated scraper. Extensions 50 are provided at the ends of each primary blade 40, the extensions also being provided with scraper blades 52. The purpose of the extensions 50 is to squeegee any asphalt which may have spilled onto the pavement adjacent to the trench and to move it back to the trench, where it can be leveled as the trencher attachment is moved forward. With reference to FIG. 5, the second scraper 54 would also serve the same purpose as the extension scraper 52 when the parts are in the configuration shown, as the scraper 54 will be outward of wall W of the trench. When the attachment is configured for a wide trench as shown in FIG. 7, the second scrapers 54 would also be provided with round bars 44 for the same purpose as the round bars shown in FIG. 5, in which case the round bars would not be used on the inner scrapers 42.

Spare scraper blades 56 will be needed, and to this end, hooks 58 are provided on the back of the primary blades 40 for the purpose of carrying some of the extra scraper blades which may be needed. The spare scrapers shown in the various FIGS. are for the purpose of grading the back fill and perhaps the first lift of asphalt. Other spares may be stored somewhere else.

In order to move the blades between the various positions illustrated, a pair of hydraulic cylinders 60 are provided. These cylinders are caused to be operated by a pair of levers (not shown) in the cab of the skid steer loader. Furthermore, various hydraulic valves are mounted within a valve housing 62 supported on the upper box beam 30 and the forwardly extending box beams 34. The valves within the housing include a pair of solenoid operated directional control valves 64 and various relief valves 66. To this end, an electrical control line 68 extends from the levers in the cab to the solenoid operated control valves 64, and the hydraulics are coupled to the existing hydraulics in the skid steer loader by hydraulic lines 70, 72. It can be seen that by this arrangement the operator of the loader can easily change the operating width of the attachment during the course of the project to accommodate changes in trench width and lift height. One end of each of the control cylinders is pivotally secured to a bracket 74 carried on the back of the primary blade 40, and the other end is pivotally secured to suitable support plates on the rear plate 28.

During operation, the skid steer loader will be moved in a forward direction, to the left in FIG. 2. During such movement asphalt material A, which has been piled up on material B, will be encountered by the trench paver attachment. Thus, the trench paver attachment is provided with skid shoes 76 which may be vertically adjusted via a screw mechanism 78 to the desired height so that when the attachment is advanced forward the asphalt A will be leveled to a suitable height. Thus as shown in the sectional view of the pavement in FIG. 1, the second or binder lift of asphalt $A_2$ been leveled to a height of 1 to 2 inches below the surface of the pavement.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims. In this regard, the terms as used in the claims are intended to include not only the designs illustrated in the drawings of this application and the equivalent designs discussed in the text, but are also intended to cover other equivalents now known to those skilled in the art, or those equivalents which may become known to those skilled in the art in the future.

What is claimed is:

1. A trench paver attachment for paving variable width trenches with asphalt, the attachment being connecting to the mounting plate assembly of a standard skid-steer loader and allowing paving of any trench from 18" to 96"; the attachment comprising:

a support assembly securable to mounting plate assembly carried by a skid-steer loader;

right and left primary blades pivotally interconnected to the support assembly;

right and left extensible and retractable hydraulic cylinders extending between spaced apart portions of the support assembly and the right and left primary blades respectively, the right and left cylinders being capable of moving the primary blades between a first position where they form an obtuse angle with each other and a second position where they form an acute angle with each other;

means to support the primary blades so that the bottom of the primary blades are parallel to the surface of the adjacent roadway;

right and left material scraper blades carried by the right and left primary blades, respectively, the width of the right and left material scraped blades being no more than the width of the trench to be paved; and means to adjustably mount the scraper blades on the primary blades so that the bottom edge of the scraper blades is either slightly above the surface of the adjacent roadway when the attachment is being used for paving the top layer of asphalt, or below the surface of the adjacent roadway and within the trench when the attachment is being used paving the base or binder layers of asphalt, or when being used for spreading backfill material within the trench.

2. The trench paver attachment as set forth in claim 1 wherein the cylinders are controlled by solenoid operated directional control valves (64), and various relief valves (66) are provided so that when a blade hits an obstruction, the blade may yield without damaging the blade.

3. A trench paver attachment for paving variable width trenches with asphalt, the attachment being connecting to the mounting plate assembly of a standard skid-steer loader and allowing paving of any trench from 18" to 96"; the attachment comprising:

a support assembly securable to mounting plate assembly carried by a skid-steer loader;

right and left primary blades pivotally interconnected to the support assembly;

right and left extensible and retractable hydraulic cylinders extending between spaced apart portions of the support assembly and the right and left primary blades respectively, the right and left cylinders being capable of moving the primary blades between a first position where they form an obtuse angle with each other and a second position where they form an acute angle with each other;

means to support the primary blades so that the bottom of the primary blades are parallel to the surface of the adjacent roadway;

right and left material scraper blades carried by the right and left primary blades, respectively; and means to adjustably mount the scraper blades on the primary blades so that the bottom edge of the scraper blades is either slightly above the surface of the adjacent roadway when the attachment is being used for paving the top layer of asphalt, or below the surface of the adjacent roadway when the attachment is being used paving the base or binder layers of asphalt, or when being used for spreading backfill material within the trench; and wherein the material engaging plates are provided at their outer ends with a round bar which slides along the side of the cut pavement, and, in the event that there is something which would interfere with the sliding movement, the round bar will cause the blade to move to the center of the trench an inch or so, thus preventing the equipment from incurring damage.

4. The trench paver attachment as set forth in claim 1, wherein the scraper blades having a width substantially less than the primary blades.

5. A trench paver attachment for paving variable width trenches with asphalt, the attachment being connecting to the mounting plate assembly of a standard skid-steer loader and allowing paving of any trench from 18" to 96"; the attachment comprising:

a support assembly securable to mounting plate assembly carried by a skid-steer loader;

right and left primary blades pivotally interconnected to the support assembly;

right and left extensible and retractable hydraulic cylinders extending between spaced apart portions of the support assembly and the right and left primary blades respectively, the right and left cylinders being capable of moving the primary blades between a first position where they form an obtuse angle with each other and a second position where they form an acute angle with each other;

means to support the primary blades so that the bottom of the primary blades are parallel to the surface of the adjacent roadway;

right and left material scraper blades carried by the right and left primary blades, respectively; and means to adjustably mount the scraper blades on the primary blades so that the bottom edge of the scraper blades is either slightly above the surface of the adjacent roadway when the attachment is being used for paving the top layer of asphalt, or below the surface of the adjacent roadway when the attachment is being used paving the base or binder layers of asphalt, or when being used for spreading backfill material within the trench; and wherein the support assembly includes a transverse box beam, a pair of forwardly extending box beams which are in a V-shaped configuration, a triangular plate below the forwardly converging box beams and a centrally located pivot assembly to which the primary blades are pivotally secured.

* * * * *